US005415583A

United States Patent [19]

Brandt, Jr.

[11] Patent Number: 5,415,583

[45] Date of Patent: May 16, 1995

[54] FUME HOOD AIR FLOW CONTROL SYSTEM

[76] Inventor: Robert O. Brandt, Jr., P.O. Box 5606 Hanover Center, Wilmington, N.C. 28403

[21] Appl. No.: 171,916

[22] Filed: Dec. 21, 1993

[51] Int. Cl.[6] ..... B08B 15/02

[52] U.S. Cl. ..... 454/61

[58] Field of Search ..... 454/56, 57, 58, 59, 454/61

[56] References Cited

U.S. PATENT DOCUMENTS 3,581,565 6/1971 Dieterich ..... 73/212
5,036,711 8/1991 Good ..... 73/861.66

FOREIGN PATENT DOCUMENTS 63730 12/1991 Australia ..... 454/61
91/01821 2/1991 WIPO ..... 454/56

*Primary Examiner*—Harold Joyce
*Attorney, Agent, or Firm*—Robert G. Rosenthal

[57] ABSTRACT

An apparatus controls the face velocity of air flowing from a room into a fume hood. The fume hood includes a movable sash and an exhaust system. An air flow measuring device such as a parallel plate pitot is positioned within the fume hood between a pair of spaced apart air foils and outputs a signal that is representative of the air velocity between the air foils. An actuator controls the fume hood exhaust system in response to pitot output. Face velocity is maintained regardless of sash position.

20 Claims, 7 Drawing Sheets

FUME HOOD AIR FLOW CONTROL SYSTEM

BACKGROUND OF THE INVENTION

This invention relates generally to the field of air flow control systems and more particularly to air flow control systems such as are employed in fume hoods.

BACKGROUND OF THE INVENTION

Fume hoods are commonly found in many settings where it is necessary to exhaust toxic gases. For example, fume hoods are found in laboratories where chemicals and gases are used in research and/or production processes, the gases being harmful to humans in the event they escape into the work place. The primary objective of fume hoods is, therefore, to prevent gases from entering the work area and causing injury to the persons present. Thus, fume hoods are equipped with systems that maintain a "face velocity" that confines the fumes within the hood and exhaust fans that remove the gases from within the hood. However, the constant flow of air which is exhausted from the fume hood is usually "conditioned". Air may be conditioned in a number of ways. For example, the most basic conditioning includes heating or cooling the air. However, air may also be conditioned in more exotic and consequently, more expensive ways such as "scrubbing" to remove particulate matter which is commonly employed in microelectronics manufacturing facilities or sterilization which may be required in medical facilities. It can thus be appreciated that conditioning air carries with it a corresponding expense and, depending on how many types of conditioning, that the cost can escalate rapidly. It would, therefore, be a useful contribution to the art if cost savings could be achieved by reducing the amount of conditioned air that was required thus allowing the installation of smaller systems with lower energy requirements, fewer maintenance procedures, and lower replacement cost.

A system of this type has been proposed in U.S. Pat. No. 4,741,257 to Wiggin et al. entitled "Fume Hood Air Flow Control". In this patent, a series of flow tubes are positioned proximate the sash area at positions corresponding to the 25%, 50%, and 75% of open positions. However, this system is not without its inherent drawbacks and deficiencies. For example, the system is only able to sense three sash positions. Thus, when the sash in located intermediate of one of the positions, more air than the minimum required to maintain face velocity is drawn into the exhaust. The foregoing is true of all systems based on discrete position sensing devices. Furthermore, when an external disturbance, such as a fan, is placed in proximity to the fume hood, the system is prone to interpret the signal incorrectly, resulting in a loss of containment.

It is, therefore, an object of the present invention to provide an improved fume hood control system.

Another object of the present invention is to provide a fume hood control system that minimizes the air flow required in order to maintain the face pressure required for safe operation.

A still further object of the present invention is to provide a control system for fume hoods that is inexpensive.

Yet another object of the present invention is to provide a fume hood control system that is easy to install and maintain.

Another object of the present invention is to provide a fume hood control system that is not prone to erroneous signals and which reliably provides containment for gases within the hood.

SUMMARY OF THE INVENTION

The present invention overcomes the drawbacks of the prior art systems through the provision of an apparatus for controlling the face velocity of air flowing between a room and a chamber, such as a fume hood. The fume hood includes a sash opening of varying size and the chamber including an exhaust system. The exhaust system includes an exhaust port in fluid communication with an environment other than the room, a fan and a control valve for moving the air therethrough. The fume hood has an air foil positioned below the sash opening. A ledge is located below the air foil and the space therebetween defines a passageway that permits fluid communication between the room and the chamber. The control system comprises an air flow measuring means positioned between the air foil and the ledge that measures the air flowing through the air foil and an actuator variably controls the exhaust system in response to the velocity pressure measured by the air flow measuring means, and the velocity pressure in the sash opening is controlled so that contaminants are safely contained within the fume hood.

BRIEF DESCRIPTION OF THE DRAWINGS

Some of the features and advantages of the invention having been briefly been stated, others will appear from the detailed description which follows, when taken in connection with the accompanying drawings, in which.

DETAILED DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
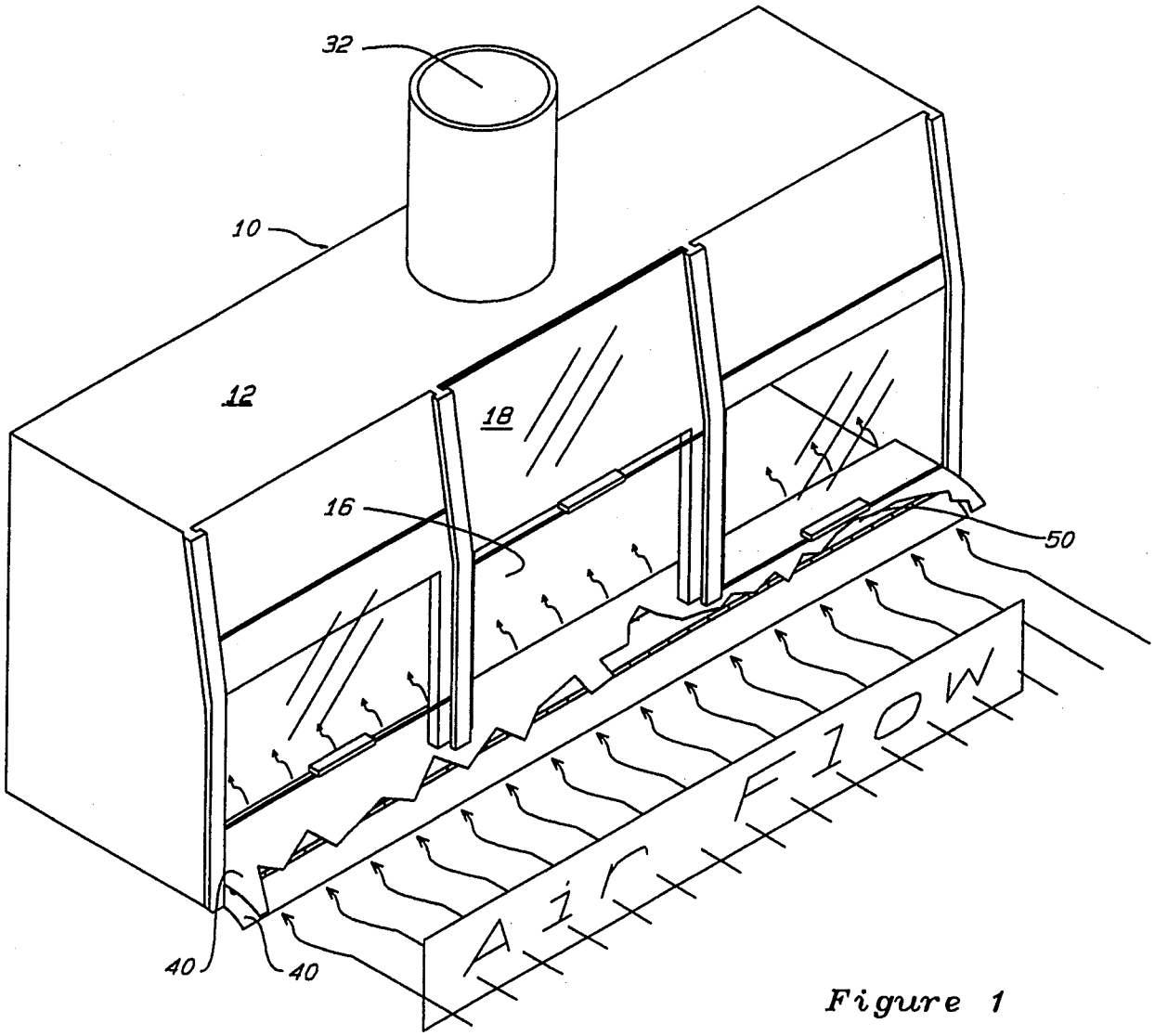
FIG. 1 is a perspective view of a fume hood including the air flow control system according to the present invention.
Figure 2:
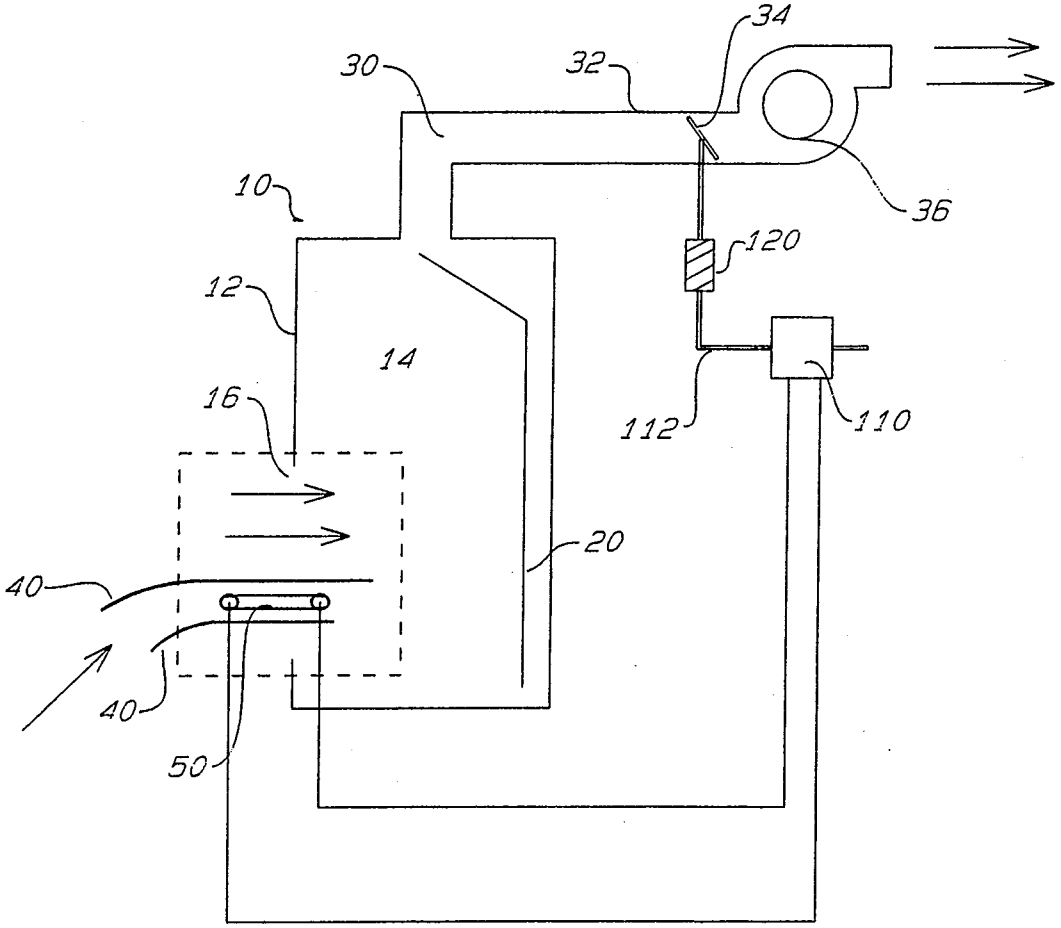
FIG. 2 is a side view of a fume hood including the air flow control system according to the present invention.
Figure 5:
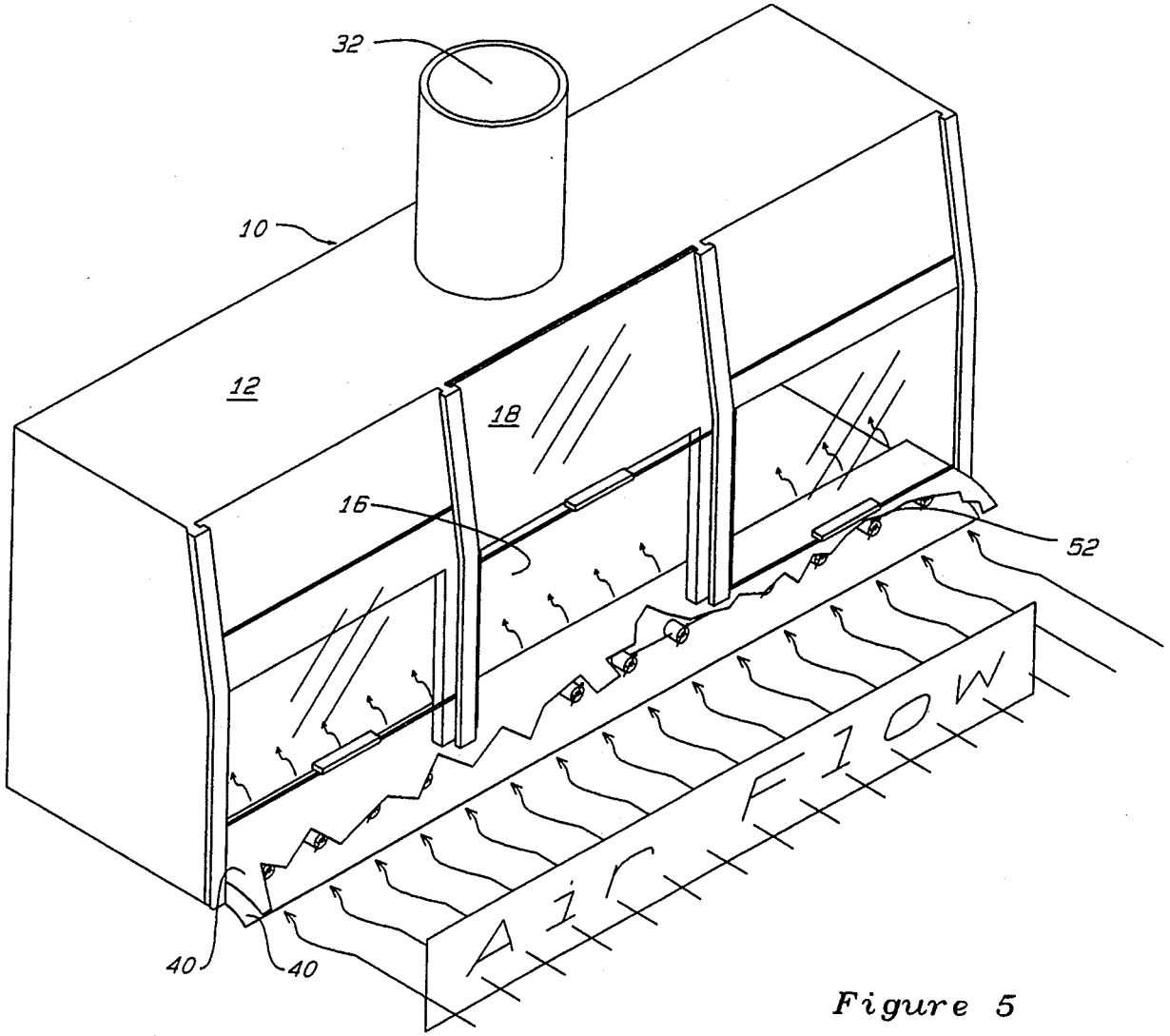
FIG. 5 is a perspective view of a fume hood including the air flow control system according to the present invention and illustrating a thermal anemometer positioned within the air foil.
Figure 6:
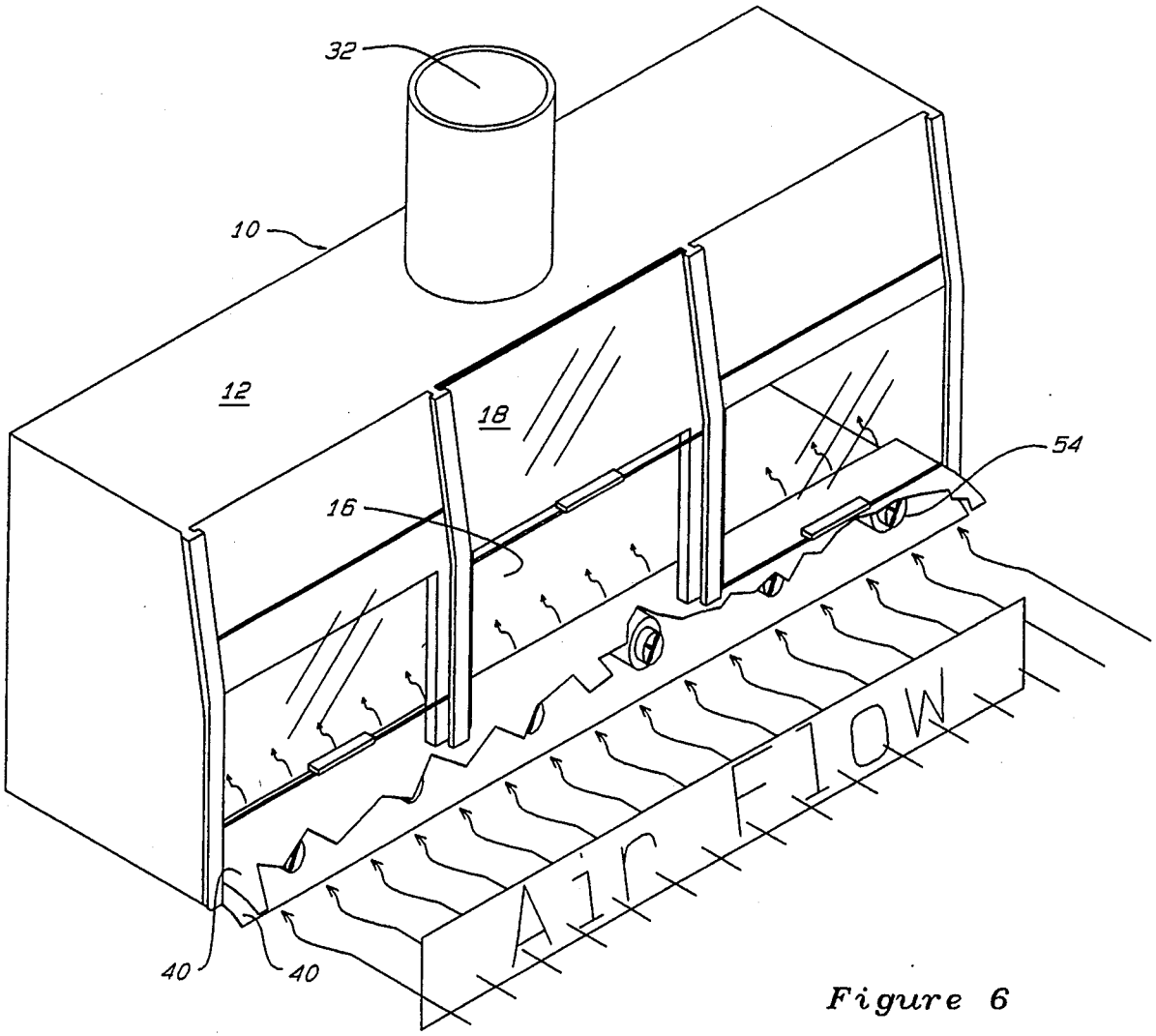
FIG. 6 is a perspective view of a fume hood including the air flow control system according to the present invention and illustrating a vane anemometer positioned within the air foil.

Referring now to the drawings and particularly to FIGS. 1 and 2, a conventional fume hood generally indicated at 10 is there illustrated. The fume hood comprises a housing 12 defining a chamber 14 and has an opening 16 in which a person performing a task within the hood is located. The opening is closeable by means of a movable sash 18 which can be raised and lowered. Located at the rear of the hood 10 is a baffle 20 which aids in distributing the air within the hood. An exhaust system 30 is located in the upper section of the fume hood and includes a duct 32 which carries air from the chamber to an environment other than the room in which the chamber is located (usually outside the building). Depending on the type and concentration of contaminants that are produced in the hood, the air being removed from the chamber may need to be treated prior to being released into the atmosphere. The exhaust system also includes a control valve 34 and an exhaust fan 36, both of which are positioned within the duct 32 and which operate to remove air from within the chamber 14 in the desired controlled fashion as will be described more fully hereinbelow. In addition, the fume hood 10 illustrated is exemplary of most modern designs in that it includes air foils 40 located beneath the sash opening 16. The lower air foil 40 is optional and was added to the present design to minimize turbulence. A planar ledge is usually found instead of the lower air foil. According to the invention, a means for measuring the velocity of the air flowing in the airfoil in the form of a parallel plate pitot 50 is provided. Notwithstanding the preference for a parallel plate pitot, conventional thermal 52 or vane 54 anemometers (see FIGS. 5 and 6, respectively) may be positioned in the within the airfoil. The airfoil may also be the conventional table type ledge as found in most systems currently in use. However, the dual airfoil as shown in FIG. 2 may also be employed, but the airfoil coefficient is changed according to the following design criteria:

$$V_{FACE} = AFC \times 4005 \sqrt{\Delta p}$$

EXAMPLE

The AFC (air foil coefficient) is the ratio between the entrance coefficient of the hood and the entrance coefficient of the air foil. A number less than 1 infers that the air flows under the air foil easier than it flows into the hood. It is hood and installation dependent. The pitot should be completely installed and firmly fixed in place before any calibration is attempted.

Figure 7:
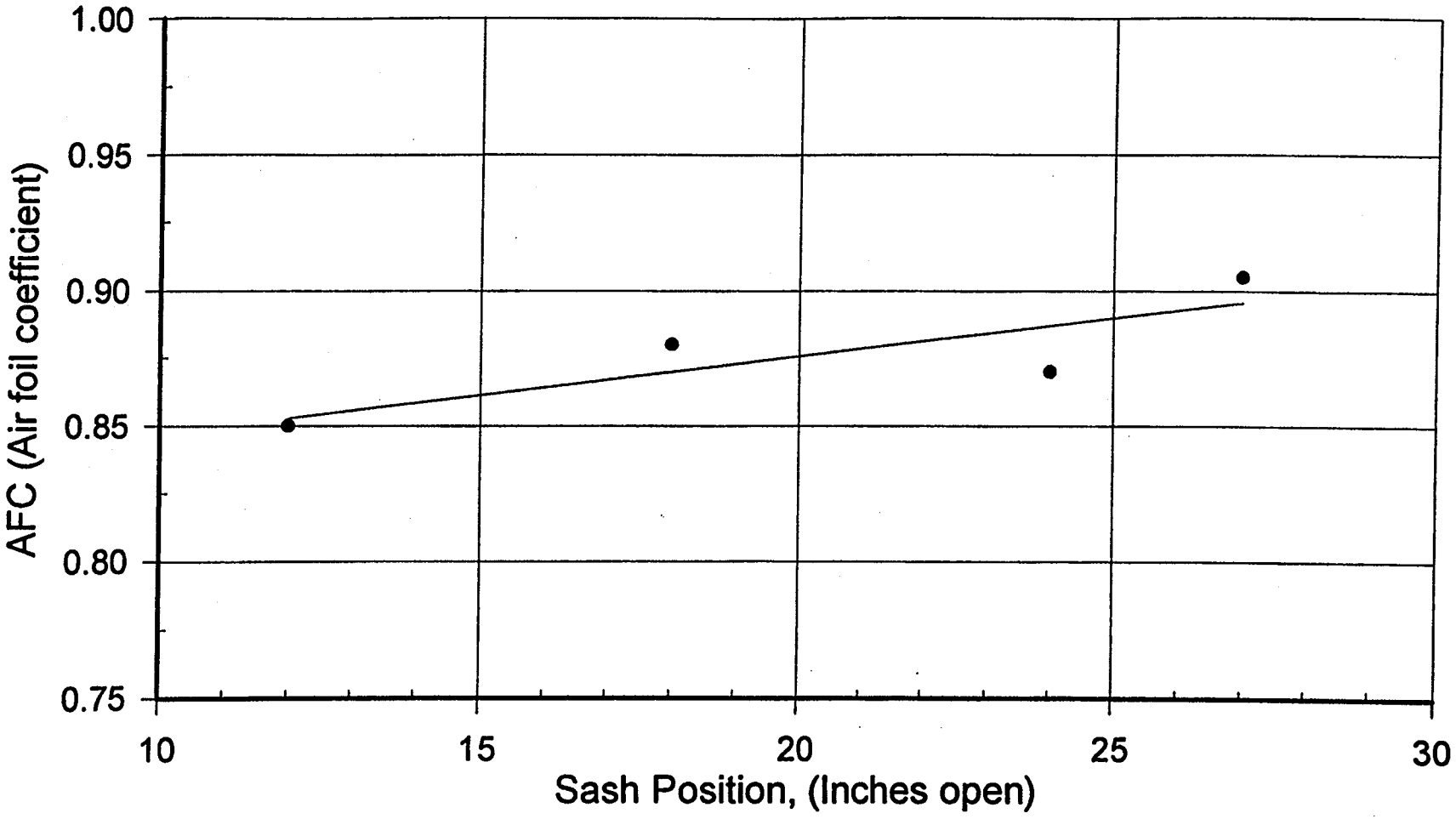
FIG. 7 is a graph of the sash position versus air foil coefficient from a typical 6 foot hood.

The graph in FIG. 7 of sash position vs AFC is taken from a typical 6 foot hood. This graph indicates the sensitivity to the Air Foil Pitot to vertical sash movement. There is no indicated sensitivity to horizontal movement. Full open is 28 inches and the by pass starts opening below 10 inches. Also, hood baffle adjustment may affect the AFC a small amount.

The equation for face velocity in feet per minute with pressure in inches wc at standard conditions is:

$$V_{FACE} = AFC \times 4005 \sqrt{\Delta p}$$

For a velocity of 100 fpm using an AFC of 0.90, then $$\Delta p = \left(\frac{V_{FACE}}{AFC \times 4005}\right)^2; = \left(\frac{100}{0.90 \times 4005}\right)^2; =$$

0.77 inch mils water column

Figure 3:
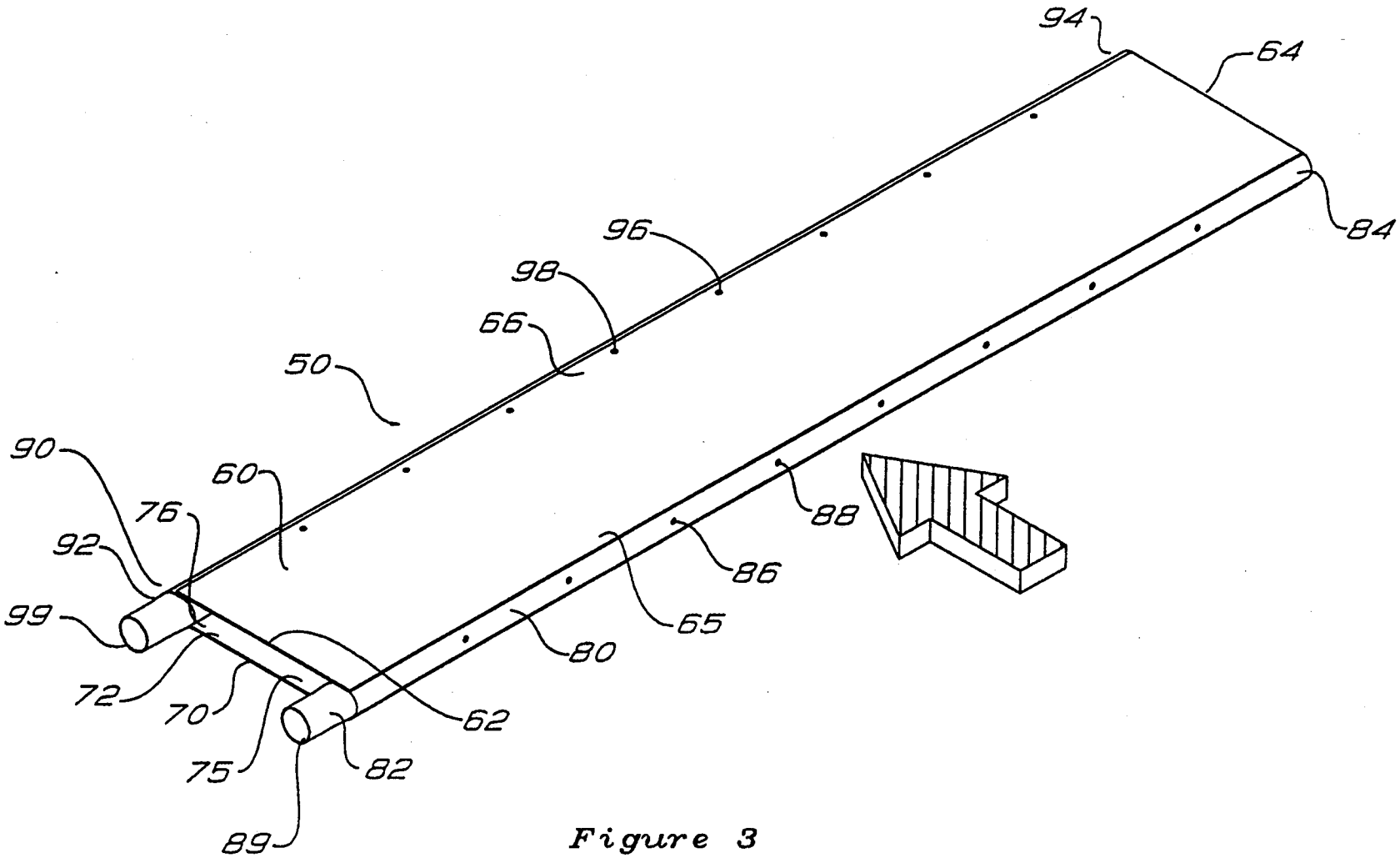
FIG. 3 is a perspective view of the parallel plate pitot incorporated into the air flow control system according to the present invention.
Figure 4A:
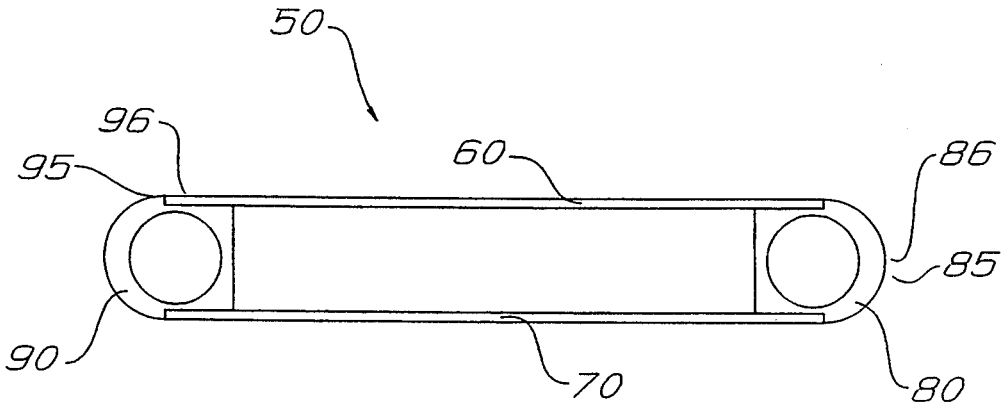
FIGS. 4*a* and 4*b* are side views of the parallel plate pitot incorporated into the air flow control system according to the present invention.

Or for a 1.5 inch mil transmitter: $\left(\frac{.77}{1.5}\right) = 51\%$ full scale The pitot 50 (FIGS. 3 and 4*a*, 4*b*) comprises a pair of metal plates 60,70 and a pair of tubes 80,90. The flat plates 60,70 are preferably made of sheets of thin metal such as stainless steel. A first plate 60 has opposing sides 62,64 and opposing leading and trailing edges 65,66 respectively. A second metal plate 70 also has opposing sides 72,74 and opposing leading and trailing edges 75,76 respectively.

With respect to dimensions, any dimension that is structural will suffice. However, design characteristics will be discussed in detail hereinbelow.

A first hollow elongate tube 80 having a proximal end 82 and a distal end 84 is connected in sandwich fashion between the first plate 60 and the second plate 70. The connection between the plates 60,70 and the tube 80 may be by any suitable means that does not disrupt fluid flow, such as by welding. The first tube 80 includes a plurality of spaced apart holes defining openings. As shown in the figures, the openings 88 are located proximate the leading edges of the first and second plates 60,70. The openings are preferably located at the forward most point of the pitot 50. The distal end 84 is sealed such as with an end cap (not shown) and the proximal end is connected to a total pressure connector sensor 89.

Figure 4B:
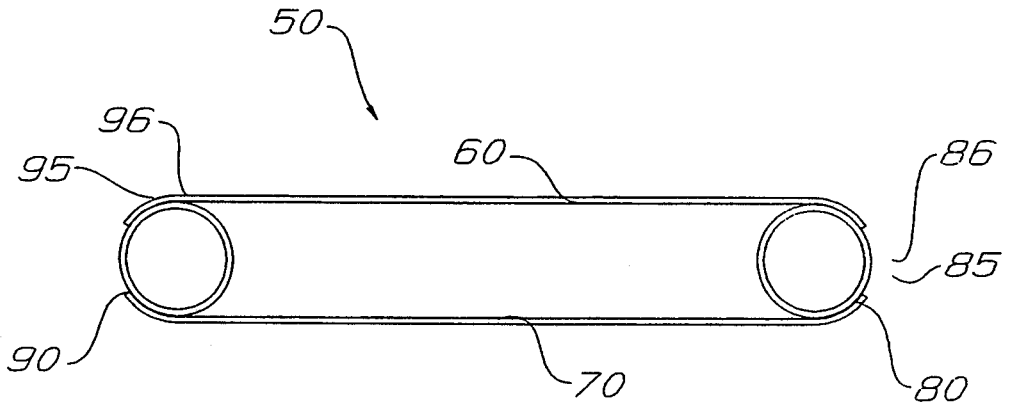

A second hollow elongate tube 90 having a proximal end 92 and a distal end 94 is connected in sandwich fashion between the first plate 60 and the second plate 70. The connection between the plates 60,70 and the tube 90 may be by any suitable means that does not disrupt fluid flow such as by welding. The second tube 90 includes a plurality of spaced apart holes defining openings. As shown in the figures openings 98 are located proximate the trailing edge of the first plate 60 and the second plate 70 and specifically they are located parallel to the plane of the first plate (FIG. 4). In the alternate embodiment of FIG. 4*b*, the first plate 60 actually overlies the tube 90 and, in this case, the openings extend through both the tube 90 and the plate 60 so that there is fluid communication between the duct and the interior of the tube. Again, as with the first tube 80, the distal end 94 is sealed and the proximal end is connected to a static pressure sensor 99.

The pitot should be constructed such that the plates 20,30 are parallel and of equal size. Similarly, the tubes 80,90 should also be parallel and of equal length and diameter. With respect to more detailed design criteria, the pitot 50 should extend across the entire flow stream (FIG. 1). Two other dimensions are also important. First, the distance between tubes 80,90 should be at least about four and preferably eight to ten times the separation distance between air foils 40 and second, the plate depth (distance between tubes) should at least be one-half the air foil separation distance.

In operation, the pitot 50 is anchored by suitable means between the airfoils 40. A fluid flow (air) passes over the pitot and at the proximal end of the first tube, the total pressure reading is taken and at the proximal end of the second tube, the static pressure is taken. The foregoing signals are then usually output to a pressure transmitter or comparator 110 which determines the velocity pressure, i.e., the difference between the total pressure and the static pressure and outputs a signal (either electrical or pneumatic, depending on the type of pressure transmitter employed) on line 112 to actuator 120 which is usually a servo well known to these skilled in the art. The servo 120 is connected to and controls the position of the control valve 34 so that the amount of air withdrawn from the fume hood is controlled in response to the air flowing through airfoil 40.

The foregoing embodiments and examples are to be considered illustrative, rather than restrictive of the invention, and those modifications which come within the meaning and range of equivalence of the claims are to be included therein.

That which is claimed is:

1. An apparatus for controlling the face velocity of air flowing between a room and a chamber through a sash opening of varying size, the chamber being of the type that includes an exhaust system including an exhaust port in fluid communication With an environment other than the room, a fan for moving air through the exhaust system, and a control valve for regulating the volume of air being withdrawn from the chamber into the exhaust system, a pair of spaced apart air foils defining a passageway permitting fluid communication between the room and the chamber and permitting fluid flow therebetween and comprising:

(a) air flow measuring means positioned between the air foils for measuring the air flowing through the passageway, and (b) actuator means for variably controlling said control valve in response to the velocity pressure measured by said air flow measuring means, whereby the face pressure in the sash opening may be controlled to safely contain contaminants within the chamber for any sash position.

2. The apparatus according to claim 1 wherein said air flow measuring means measures the velocity pressure of the air flowing through the passageway.

3. The apparatus according to claim 1 wherein said air flow measuring means comprises a pitot.

4. The apparatus according to claim 3 wherein said pitot comprises a parallel plate pitot.

5. The apparatus according to claim 4 wherein said parallel plate pitot comprises:

a first plate having opposing sides and opposing leading and trailing edges;

a second plate having opposing sides and opposing leading and trailing edges and wherein said first plate overlies said second plated in spaced relation;

a first hollow elongate tube having a proximal end and a distal end connected in sandwich fashion between said first plate and said second plate proximate the leading edges thereof, said first tube including a plurality of spaced apart holes defining openings located proximate the leading edges of said first plate and said second plate;

a second hollow elongate tube having a proximal end and a distal end connected in sandwich fashion between said first plate and said second plate, said second tube being positioned proximate the trailing edges thereof, said second tube including a plurality of spaced apart holes defining openings, said openings being proximate the trailing edge of said first plate and said second plate.

6. The pitot according to claim 5 wherein said openings in said first tube are perpendicular to the plane of said plates; and wherein said openings in said second tube are parallel to the plane of said plate.

7. The pitot according to claim 5 wherein said first tube and said second tube are of equal diameters.

8. The pitot according to claim 5 wherein the distance between said first tube and said second tube is at least four times the diameter of said tubes.

9. The pitot according to claim 5 wherein the length of said pitot is approximately one-half the width of the passageway into which it is adapted to be placed and wherein the diameter of said first tube and said second tube is at least about one forth the passageway depth.

10. The apparatus according to claim 1 wherein said air flow measuring means comprises a plurality of air velocity sensors positioned along the length of said passageway.

11. The apparatus according to claim 1 wherein said air flow measuring means comprises thermal anemometers.

12. The apparatus according to claim 1 wherein said air flow measuring means comprises vein anemometers.

13. A method for controlling the face velocity of air flowing between a room and a chamber through a sash opening of varying size, the chamber being of the type that includes an exhaust system having an exhaust port in fluid communication with an environment other than the room, a fan for moving the air through the exhaust system and a control valve for regulating the volume of air being withdrawn from the chamber into the exhaust system, a pair of spaced apart air foils defining a passageway permitting fluid communication between the room and the chamber and permitting fluid flow therebetween and comprising the steps of:

measuring the velocity of the air flowing in the passageway, and outputting a signal representative of the velocity pressure;

converting the velocity pressure signal into a proportional output signal, moving the control valve in response to the proportional output signal, whereby the velocity pressure is maintained under all conditions of operation of the chamber.

14. The method of claim 13 wherein the step of measuring is performed by a pitot positioned in the passageway.

15. The method of claim 13 wherein the pitot is a parallel plate pitot.

16. The method of claim 13 wherein the proportional signal is an electrical signal.

17. An apparatus for controlling the face velocity of air flowing between a fume hood chamber and a room through an adjustable sash opening, the fume hood being of the type that includes an exhaust system having an exhaust port in fluid communication with an environment other that the room, a fan for moving air through the fume hood and out the exhaust system, a control valve in the exhaust system for regulating the volume of air being withdrawn from the fume hood, a pair of spaced apart air foils defining a passageway permitting fluid communication between the room and the chamber and permitting fluid flow therebetween and comprising:

(a) air flow measuring means positioned between the air foils for measuring the air flowing through the passageway, and (b) actuator means for variably controlling said control valve in response to the velocity pressure measured by said air flow measuring means, whereby the face pressure in the sash opening may be controlled to safely contain contaminants within the fume hood for any sash position.

18. The apparatus according to claim 17 wherein said air flow measuring means comprises a parallel plate pitot.

19. The apparatus according to claim 17 wherein said air flow measuring means comprises a vane anemometer.

20. The apparatus according to claim 17 wherein said air flow measuring means comprises a thermal anemometer.

* * * * *